United States Patent [19]

Kasa et al.

[11] Patent Number: 4,811,374

[45] Date of Patent: Mar. 7, 1989

[54] APPARATUS FOR SETTING EXPOSURE PARAMETERS OF AN X-RAY GENERATOR

[75] Inventors: Zoltan Kasa; Istran Farkas, both of Columbus, Ohio

[73] Assignee: Medicor USA Ltd., Columbus, Ohio

[21] Appl. No.: 930,802

[22] Filed: Nov. 13, 1986

[51] Int. Cl.[4] ..... H05G 1/46

[52] U.S. Cl. ..... 378/96; 378/118; 378/110

[58] Field of Search ..... 378/96, 97, 98, 101, 378/108, 109, 110, 111, 112, 114, 115, 117, 118; 364/414

[56] References Cited

U.S. PATENT DOCUMENTS

| | | | |
|---|---|---|---|
| 4,035,648 | 7/1977 | Patel | 378/118 |
| 4,072,865 | 2/1978 | Craig et al. | 378/118 |
| 4,158,138 | 6/1979 | Hellstrom | 378/98 |
| 4,160,906 | 7/1979 | Daniels et al. | 378/118 |

*Primary Examiner*—Carolyn E. Fields

*Assistant Examiner*—Joseph A. Hynds

*Attorney, Agent, or Firm*—Handal & Morofsky

[57] ABSTRACT

An apparatus for setting the exposure parameters of an X-ray generator that comprises an X-ray transformer for supplying high voltage and filament current to an X-ray tube, in which data relating to the functional relationships between the unloaded voltage of the X-ray transformer, the loaded voltage thereof, the anode current of the X-ray tube and the filament current are stored in the memory of a processor, and based on a measured unloaded voltage and a preset mAs exposure value the processor calculates and displays the loaded high voltage, sets a suitable discrete filament current and determines the exposure time corresponding to the predetermined mAs value in such a way that the X-ray tube cannot be overloaded. If the predetermined exposure data cannot be set due to overload, the processor indicates this fact, whereby the operator can either adjust the voltage or change the exposure parameters.

7 Claims, 3 Drawing Sheets

APPARATUS FOR SETTING EXPOSURE PARAMETERS OF AN X-RAY GENERATOR

FIELD OF THE INVENTION

The invention relates to an apparatus for setting exposure parameters of an X-ray generator, in which the parameters are set prior to exposure according to instructions received by an operator and the actual parameters of the exposure should possibly be equal to the preset values.

BACKGROUND OF THE INVENTION

It has always been a problem in the field of X-ray technique that certain parameters of exposure such as the anode voltage and current of the X-ray tube should be set when the X-ray generator is in the unloaded state i.e. the voltage is different from that under load and there is no current through the tube. The operator wishes to make sure that during the exposure the actual parameters be as closely equal to the preset values as possible. Further, the control of the X-ray generator should prevent the X-ray tube from being overloaded due to incorrectly set parameters.

The setting of the high voltage is generally done by using appropriate switches, allowing the voltage to be adjusted in course and fine steps. The unloaded high voltage $V_{in}$ is higher than the voltage $V_A$ during exposure due to the internal resistance of the X-ray generator. The load is constituted by the anode current $I_A$ which itself is a function of the voltage $I_A$ and of the filament current $I_F$. Under unloaded conditions one can adjust the voltage $V_{in}$ and the filament current $I_F$ and this should be done in such a way that under loaded conditions the actual voltage $V_A$ and current $I_F$ correspond to the expected values. The exposure time is generally too short for establishing a closed regulation loop.

Apart from some very expensive types in the low and medium cost category of X-ray generators, voltage compensation is made in such a way that there are two switches moved together when the filament current is set and the second switch inserts respective resistors in series with a voltmeter measuring the unloaded voltage $V_{in}$. The values of the resistors are chosen in such a way that in each position the voltage reading equals to $V_A$ instead of $V_{in}$. The display of the expected voltage $V_A$ is of significance to the operator, who is generally an X-ray specialist.

The anode current $I_A$ cannot be set simply by means of the filament current $I_F$, since with a given filament current the anode current increases with increasing voltage. In a widely used solution the filament is supplied from a source which includes a stabilized AC source often referred to as an isostat and a secondary winding of a separate transformer connected to the high-voltage AC lines, and this secondary winding was connected in series with the isostat, with reversed phase relative thereto, so that the resulting filament supply voltage was linearly decreased when the high voltage increased and vica versa. The discrete setting of the filament current occurred by means of serially connected resistors.

Substantially such a control can be found in the X-ray generator of U.S. Pat. No. 4,158,138 and in a number of types present nowadays in the U.S. market.

OBJECT OF THE INVENTION

The main object of the present invention is to provide a simple and reliable control in which the expected values of the anode voltage and current can be predicted more accurately than by the ways described hereinabove and which includes an overload protection.

SUMMARY OF THE INVENTION

According to the invention, it has been recognized that the existing implicit relationships between the various parameters can be stored in the memory of a conventional processor, and if the processor is supplied with all available information concerning actual unloaded voltage and filament current values as well as with required data for the exposure to be set, then the stored values can be used to define accurately the expected loaded values by using a simple iterative algorythm. To this end one may cease using fixed exposure times and selectable current values, and rather the product of the anode current and the exposure time should be defined as a setting parameter for the X-ray dosage. With adjusting the exposure time the number of discrete filament currents can be reduced substantially, whereby a number of components can be spared.

BRIEF DESCRIPTION OF THE DRAWINGS

The invention will now be described in connection with preferred embodiments thereof, with reference to the accompanying drawings. In the drawing:

FIG. 1 shows only those blocks of an X-ray generator which are required for understanding the present invention. X-ray transformer 10 comprises input terminals 11, 12 for connection to a suitable AC mains voltage, a predetermined number of output terminals 13 to 15 selectable by major switch 16 and a secondary coil 17 connected in series with the major switch 16. The secondary coil 17 has a predetermined number of further terminals 18 to 20 coupled to respective ports of minor switch 21. The output voltage of the X-ray transformer 10 appears on supply lines 22, 23 and can be varied by the major switch 16 in coarse steps and by the minor switch 21 in finer steps.

Figure 1:
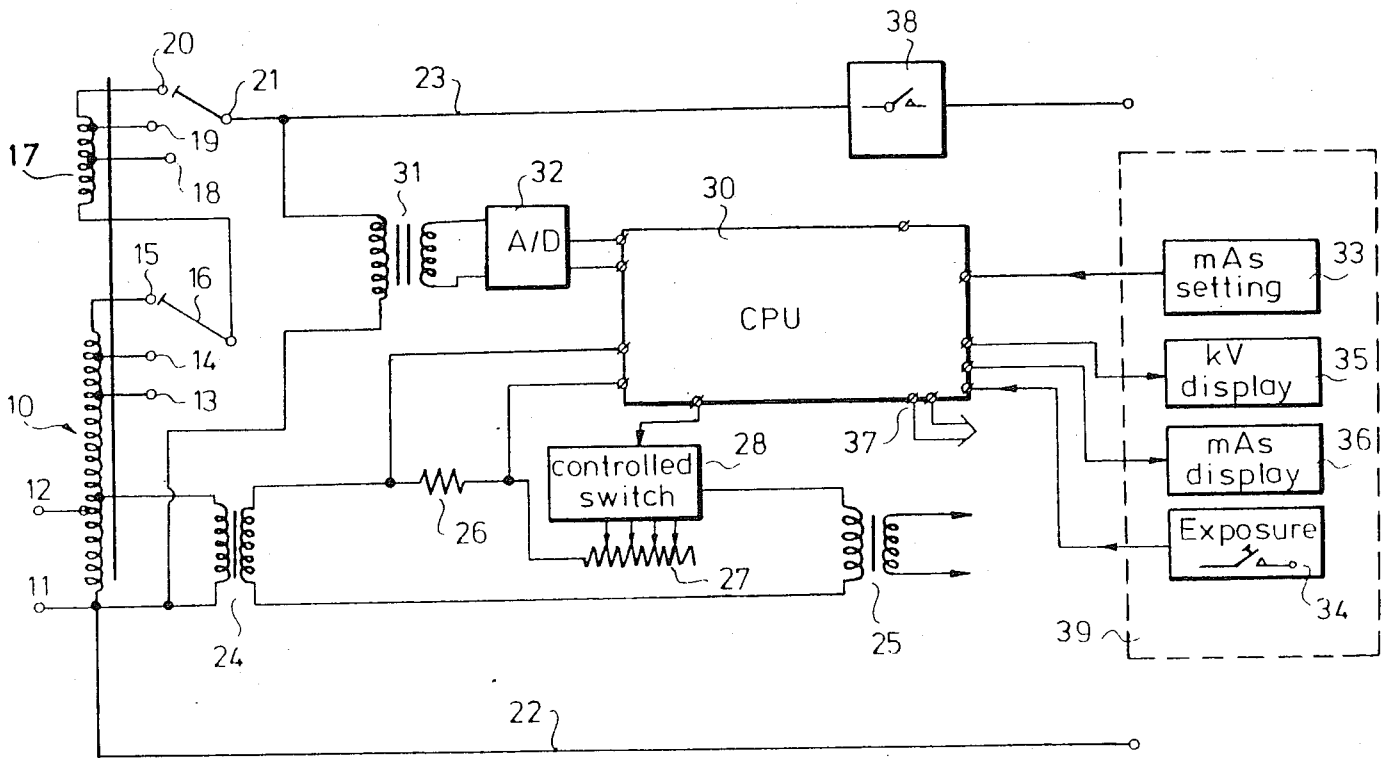
FIG. 1 shows the general block diagram of the apparatus.

A constant voltage transformer referred to as isostat 24 is connected to a pair of fixed terminals of the X-ray transformer 10 for supplying current to a filament transformer 25. There are provided between the isostat 24 and the filament transformer 25 a filament current sensor 26, a serial resistor 27 with a predetermined number of tapping points and controlled switch 28.

A central processor unit 30, for example a general purpose microprocessor chip, is used to perform the overall control of the X-ray generator. To this end the procesor 30 receives information on the actual high voltage between the supply lines via transformer 31 and analog to digital converter 32, on the filament current through the sensor 26, on the required dosage of the exposure expressed in mAs value from dosage setting unit 33 and on the moment of the exposure from exposure button 34. The processor 30 supplies information on the exposure parameters in the form of a kV reading to kV display 35 and of a mAs reading to a dosage display 36. Port 37 of the processor supplies exposure information to an interface or data-line which facilitates correct documentation of each exposure. The exposure is controlled by the processor 30 by activating exposure switch 38 if the exposure button 34 has been pushed and the conditions required for the exposure are all met.

The X-ray generator comprises preferably a control box 39 shown by dashed line in FIG. 1 which contains the control and display means necessary for communicaton with the operator. The major and minor switches 16 and 21 used for setting the kV value are also arranged in the control box 39.

The operation of the X-ray generator according to the invention will be explained on the basis of the diagrams shown in FIGS. 2 to 4.

Before any exposure, there is practically no load on the X-ray transformer and the voltage received by the processor 30 from the A/D converter 32 in digital form depends on the actual settings of the major and minor switches 16 and 21 and on the momentary value of the mains voltage. In the diagrams of FIGS. 2 and 3 the unloaded or input voltage $V_{in}$ is the one appearing across the supply lines 22 and 23 and the voltage delivered by the A/D converter 32 is proportional therewith. During exposure the actual voltage $V_A$ on the X-ray tube is lower than $V_{in}$, since the anode current $I_A$ exerts a significant load on the transformer which has a finite internal resistance, thus its output decreases with increasing load.

The anode current $I_A$ depends on the filament current $I_F$ of the X-ray tube and on the anode voltage $V_A$. The setting of the filament current $I_F$ occurs in discrete steps by means of the controlled switch 28 that selects a suitable resistance value for the resistor 27 connected in series with the filament supply. The processor 30 sets the switch 28 to one of N possible states and each of these states is associated with a respective filament current between $I_{F1}$ to $I_{FN}$. Let us suppose that in each step the filament current decreases i.e. $I_{Fi} > I_{F(i+1)}$.

Figure 2:
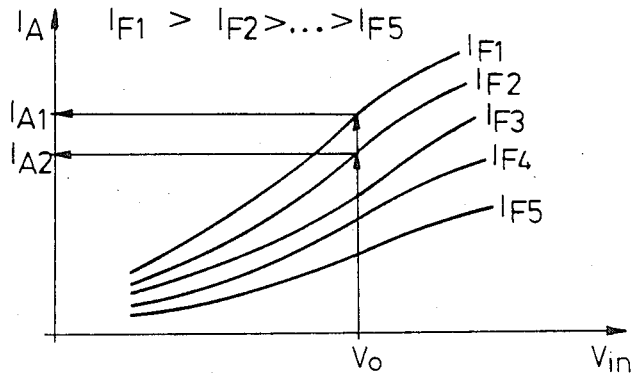
FIGS. 2 and 3 show the tube current $I_A$ and voltage $V_A$ as a function of the unloaded voltage $V_{in}$.

FIG. 2 shows the anode current $I_A$ versus unloaded voltage $V_{in}$ curves parametered by five discrete filament current values $I_{F1}$ to $I_{F5}$. These curves are highly dependent on the type of the X-ray tube driven by the X-ray generator and can be obtained either from manufacturer's catalogues or can be determined experimentally.

Figure 3:
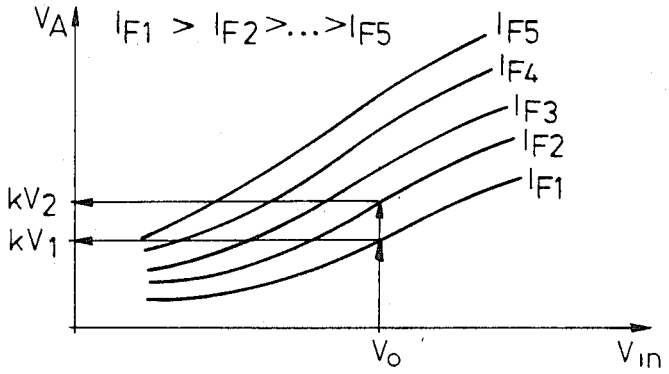

The loaded tube voltage $V_A$ versus unloaded transformer voltage $V_{in}$ curves are illustrated in FIG. 3, in which the filament current $I_F$ forms the parameter. It can be observed that the order of the filament current is reverse compared to that of the diagrams shown in FIG. 2, i.e. the largest filament current $I_{F1}$ is associated with the lowest anode voltage which is quite logical, since the largest current imposes the highest load on the transformer. The diagrams of FIG. 3 show mainly the properties of the X-ray transformer, however, the properties of the X-ray tube exert an influence on these curves, since the filament current can determine the tube current $I_A$ as a function of the anode voltage only. The curves of FIG. 3 can be determined by actual measurements or on the basis of manufacturer's data.

In adjusting the exposure parameters one should bear always in mind that any exposure can be carried out only if it cannot overload the X-ray tube. FIG. 4 shows a typical load limit diagram for an X-ray tube, in which the maximum allowed dissipated power $P = I_A \cdot V_A$ is illustrated as a function of the exposure time.

Figure 4:
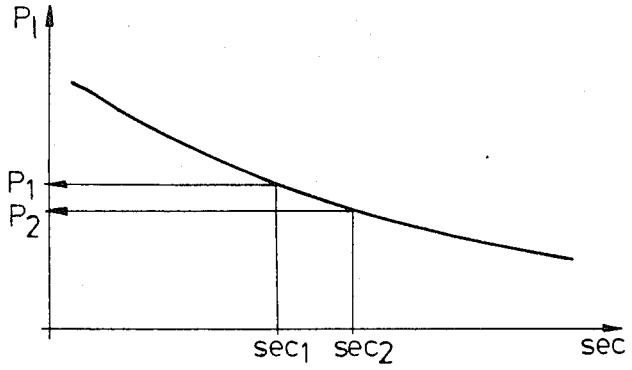
FIG. 4 shows the load limit diagram versus exposure time.

The present invention utilises the implicit relationships between the curves of FIGS. 2 to 4 in such a way that these curves are stored in an appropriate form in the memory of the processor 30. The term "appropriate form" might cover the storage of a number of tables containing data of the curves or the use of mathematical functions defining the curves which can be established by known mathematical approximation methods.

In the present X-ray generator the main parameter which can be set by the operator is the exposure dosage expressed in mAs units. The tube voltage $V_A$ expressed in kV units is always displayed to the operator before an exposure is carried out, and if the operator selects an other kV value by adjusting the major and/or minor switches, the processor will recalculate and adjust the filament current and the exposure time.

Figure 5:
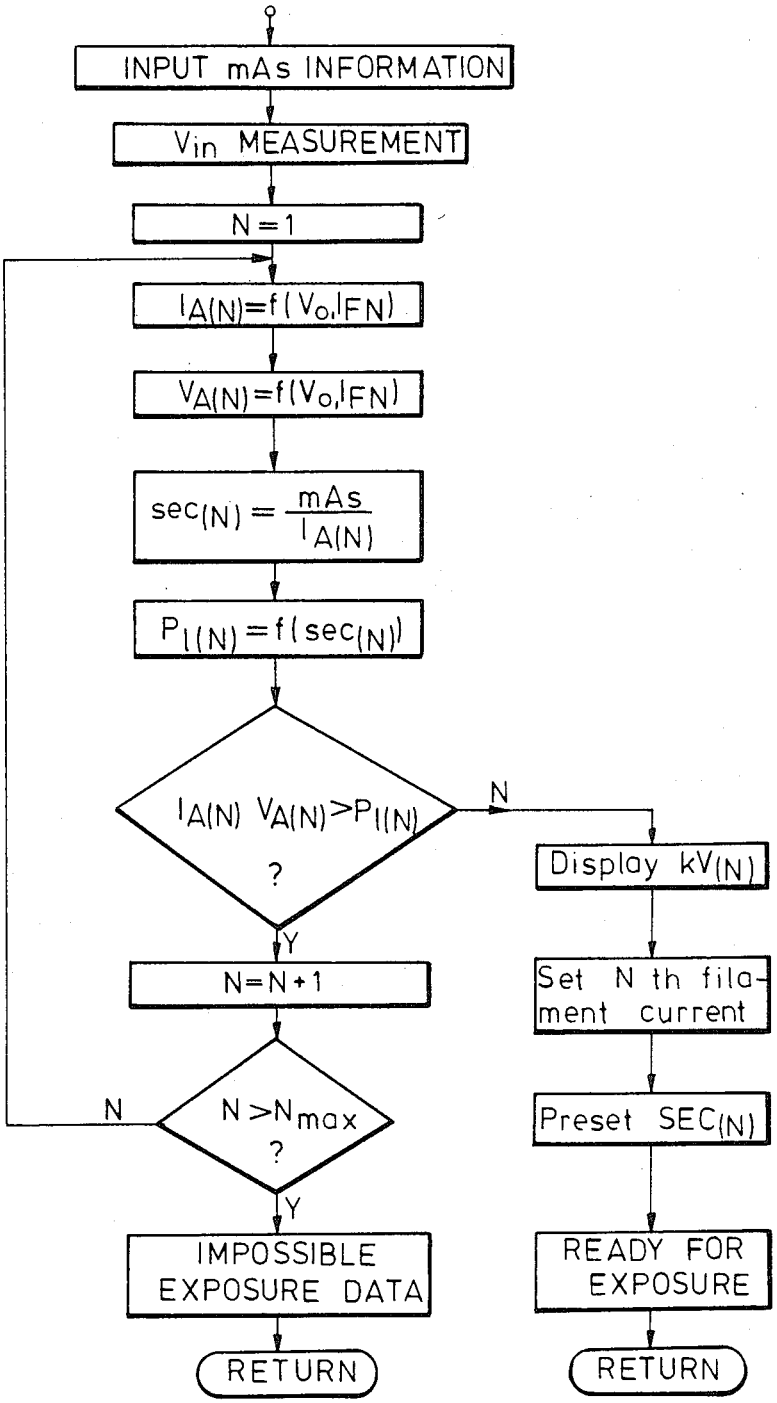
FIG. 5 shows a flow chart for programming the processor.

FIG. 5 shows the flow chart of the software used in the processor 30, and the operation of the X-ray generator will be described with reference to this flow chart.

Before carrying out any exposure the operator should set at least the required dosage i.e. the mAs value of the exposure. It is also rather likely that the operator will set the major switch to an expected required voltage value. In the first two input steps the processor 30 reads the mAs value from the unit 33 and the unloaded voltage $V_{in}$ into its memory. Let us name this voltage as $V_o$. At the start of every setting procedure the processor 30 tries to drive the highest possible current through the filament, therefore it sets the $N=1$ value.

In the next step the processor 30 uses the relationship shown in FIG. 2 between the actual unloaded voltage $V_o$ and the anode current $I_A$ which is stored in its memory either in the form an an analytical equation or of tables and determines the value $I_{A(N)} = f\,(V_o, I_{F(N)})$ for $N=1$.

Similarly, on the basis of the actual voltage $V_o$ the processor uses the stored relationship $V_{A(N)} = f(V_o, I_{F(N)})$ and determines the kV value for $N=1$.

The exposure time in secundum units will be calculated from the equation: $\sec(N) = mAs/I_{A(N)}$ for $N=1$. The processor will now establish the tube load limit $P_1$ for the calculated exposure time on the basis of the stored load limit diagram of FIG. 4. A logical decision will now be made, i.e. the processor 30 examines whether the actual dissipated power on the X-ray tube which can be expressed as $P_A = V_{A(N)} \cdot I_{A(N)}$ is higher or lower than the limit value $P_1$. If the actual power is lower than the limit value, the exposure is possible and the processor selects the N branch of the flow chart, while if an overload is established, the processor increases the value of N to $N+1$ and starts recalculating the values of $I_{A(N)}$, $V_{A(N)}$, sec, $P_A$ and $P_1$. If during such an iteration there will be an overload even in case of the smallest filament current $I_N$, then the processor indicates the operator on the display that the exposure data set by him are impossible. In response thereto the operator should either select a lower voltage setting or a smaller mAs value.

If the processor finds at last that the exposure is possible, it displays the loaded anode voltage $V_A$ in kV value, then sets the controlled switch 28 to the position corresponding to the actual value of N, sets the value of the exposure time in an internal counter or store, whereafter delivers a ready signal for the operator indicating that the exposure button 34 can be pushed. From this time on the pushing of this button starts an exposure with the required parameters. The exposure switch 38 will be closed for the period defined by the stored secundum value. The parameters can be recorded by using the output port 37 of the processor.

The starting of the exposure includes all other routine operations such as starting anode rotation or switching out a preheating of the filament, etc.

The operation described hereinabove will now be illustrated by means of a numeric example:

The operator sets the dosage as 100 mAs. In the first measurement step the unloaded voltage determined at the output of the A/D converter 32 is $V_o=200$ V. The processor starts with N=1 and establishes the following values: $I_{A1}=200$ mA, $V_{A1}=100$ kV. The anode dissipation $P_{A1}=16$ kVA (calculated value). The calculated exposure time will be: sec=100 mAs/200 mA=0.5 sec. For this exposure time the limit power is $P_{11}=12$ kW which is lower than the actual value of $P_{A1}=16$ kVA. With such an exposure a tube overload would take place. The processor increases N from 1 to 2. With this new setting the following values are obtained: N=2, $I_{A2}=100$ mA, $V_{A2}=86$ kV, $P_{A2}=8.6$ kVA, $sec_2=1$ sec, $P_{12}=9$ kW With such data the exposure is possible and an exposure ready signal is delivered to the operator.

By using the X-ray generator according to the present invention the predicted values of the exposure will approximate the actual ones with a substantially smaller error than in case of conventional generators. The increase in accuracy does not require any increase in the number of discrete steps in the adjustment of the filament current.

A saving in components is obtained, since the loaded kV value is established without the need of a double switch with a number of resistors, and there will be no need for an additional transformer in the filament supply circuit for negatively compensating the filament current if the high voltage is increased. The omission of that transformer enables the preheating of the filament from the isostat 24, whereby a faster response to the pushing of the exposure button is obtained.

We claim:

1. Apparatus for setting exposure parameters of an X-ray generator comprising:

(a) an X-ray tube transformer, (b) a plurality of output terminals, on said X-ray tube transformer, (c) switching means connected to said output terminals, (d) a pair of high voltage lines selectively coupled to said output terminals by said switching means, (e) an X-ray tube, (f) exposure switching means for supplying high voltage from said lines to said X-ray tube during a predetermined exposure period, (g) exposure means for determining a starting moment of an exposure period, (h) setting means for determining dosage of the exposure, (i) a filament transformer for heating a filament of said tube, (j) filament supply means for coupling a filament current selectable from a plurality of discrete current values to said filament transformer, (k) a processor with a first input receiving a digitized signal representing an unloaded voltage of said X-ray tube transformer, a second input receiving the output of said setting means representing the product of tube current and time of exposure, and a third input coupled to said exposure means, said processor comprising means for storing certain values of the tube current and voltage during exposure for any value of said digitized signal and for any discrete value of said filament current, as well as load limit values of the X-ray tube for any possible value of exposure time, said processor being coupled to a filament current selecting input of said filament supply means and enabling input of said exposure switching means and being programmed for determining from said unloaded voltage and stored values, expected loaded values of said tube voltage and tube current associated with said digitized signal and with a first one of said discrete filament current values, then calculating the exposure time and expected load on said tube, then determining from said storing means the load limit associated with the calculated value of said exposure time, then comparing the expected load with the established load limit and repeating the above steps by selecting a subsequent lower one of said filament current values if the expected load exceeds said load limit and setting the actual filament current and exposure time if the expected load is within the load limit.

2. The apparatus as claimed in claim 1, further comprising display means coupled to said processor for displaying the actual value of said voltage and said dosage when said exposure has been enabled.

3. The apparatus as claimed in claim 1, further comprising a filament current sensor means connected to a further input of said processor.

4. The apparatus as claimed in claim 3, in which said processor comprises an output port for delivering digital representations of exposure parameters set thereby.

5. The apparatus as claimed in claim 1, in which said filament supply means comprises an isostat generating a constant voltage.

6. Apparatus for setting exposure parameters of an X-ray generator comprising:

(a) an X-ray tube transformer, (b) a plurality of output terminals, on said X-ray tube transformer, (c) switching means connected to said output terminals, (d) a pair of high voltage lines selectively coupled to said output terminals by said switching means, (e) an X-ray tube, (f) exposure switching means for supplying voltage from said lines to said X-ray tube during a predetermined exposure period, (g) exposure means for determining a starting moment of an exposure period, (h) setting means for determining dosage of the exposure, (i) a filament transformer for heating a filament of said tube, (j) filament supply means for coupling a filament current selectable from a plurality of discrete current values to said filament transformer, (k) a processor with a first input receiving a digitized signal representing an unloaded voltage of said X-ray tube transformer, a second input receiving the output of said setting means representing the product of tube current and time of exposure, and a third input coupled to said exposure means, said processor comprising means for storing certain values of the tube current and voltage during exposure for any value of said digitized signal and for any discrete value of said filament current, as well as load limit values of the X-ray tube for any possible value of exposure time, said processor being coupled to a filament current selecting input of said filament supply means and enabling input of said exposure switching means and being programmed for determining from said unloaded voltage and stored values, expected loaded values of said tube voltage and tube current associated with said digitized signal and with a first one of said discrete filament current values, then calculating the exposure time and expected load on said tube, then determining from said storing means the load limit associated with the calculated value of said exposure time, then comparing the expected load with the established load limit and repeating the above steps by selecting a subsequent lower one of said filament current values if the expected load exceeds said load limit and setting the actual filament current and exposure time if the expected load is within the load limit, said filament supply means comprising a current source, resistor means with a predetermined number of terminals, a controlled switch having inputs coupled to said terminals, an output coupled to said filament transformer and control input means coupled to said processor to selectively connect a predetermined portion of said resistor means in series between said current source and said filament transformer.

7. Apparatus for setting exposure parameters of an X-ray generator comprising:

(a) an X-ray tube transformer, (b) a plurality of output terminals, on said X-ray tube transformer, (c) switching means connected to said output terminals, (d) a pair of high voltage lines selectively coupled to said output terminals by said switching means, (e) an X-ray tube, (f) exposure switching means for supplying voltage from said lines to said X-ray tube during a predetermined exposure period, (g) exposure means for determining a starting moment of an exposure period, (h) setting means for determining dosage of the exposure, (i) a filament transformer for heating a filament of said tube, (j) filament supply means for coupling a filament current selectable from a plurality of discrete current values to said filament transformer, (k) a processor with a first input receiving a digitized signal representing an unloaded voltage of said X-ray tube transformer, a second input receiving the output of said setting means representing the product of tube current and time of exposure, and a third input coupled to said exposure means, said processor comprising means for storing certain values of the tube current and voltage during exposure for any value of said digitized signal and for any discrete value of said filament current, as well as load limit values of the X-ray tube for any possible value of exposure time, said processor being coupled to a filament current selecting input of said filament supply means and enabling input of said exposure switching means and being programmed for determining from said unloaded voltage and stored values, expected loaded values of said tube voltage and tube current associated with said digitized signal and with a first one of said discrete filament current values, then calculating the exposure time and expected load on said tube, then determining from said storing means the load limit associated with the calculated value of said exposure time, then comparing the expected load with the established load limit and repeating said steps by selecting a subsequent lower one of said filament current values if the expected load exceeds said load limit and setting the actual filament current and exposure time if the expected load is within the load limit, wherein, said X-ray tube transformer has a primary winding coupled across said high voltage lines and a secondary winding, and an analog to digital converter with an analog input coupled to said secondary winding and a digital output connected to said first input of said processor to provide a digitized voltage signal corresponding to the voltage across said lines.

* * * * *